US006923387B2

(12) United States Patent
Carlisle et al.

(10) Patent No.: US 6,923,387 B2
(45) Date of Patent: Aug. 2, 2005

(54) DEPOSIT CONTROL IN FUEL INJECTOR NOZZLES

(75) Inventors: Hugh William Carlisle, Sorrento (AU); Robert Walter Frew, Scarborough (AU); John Richard Mills, Williamsburg, VA (US); Peter John Murdoch, Mosman Park (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 168 days.

(21) Appl. No.: 10/257,385

(22) PCT Filed: Apr. 20, 2001

(86) PCT No.: PCT/AU01/00459

§ 371 (c)(1),
(2), (4) Date: Dec. 19, 2002

(87) PCT Pub. No.: WO01/81757

PCT Pub. Date: Nov. 1, 2001

(65) Prior Publication Data

US 2004/0035954 A1 Feb. 26, 2004

(30) Foreign Application Priority Data

Apr. 20, 2000 (AU) ..... PQ7081

(51) Int. Cl.[7] ..... F02M 61/10

(52) U.S. Cl. ..... 239/533.12; 239/533.2; 239/533.3

(58) Field of Search ..... 239/533.3, 533.4, 239/533.9, 533.12, 533.2

(56) References Cited

U.S. PATENT DOCUMENTS 2,035,203 A * 3/1936 Smith ..... 239/5

4,815,706 A 3/1989 Feuling (Continued)

FOREIGN PATENT DOCUMENTS

| | | |
|---|---|---|
| WO | WO 91/11609 | 8/1991 |
| WO | WO 98/07980 | 2/1998 |

OTHER PUBLICATIONS

JP 08338343A (ZEXEL KK) Dec. 24, 1996 Figures 1 and 2 Nozzle valve assembly for IC engine such as diesel engine—in which depth of notch has sharp inclination at one side relative to other side so that length of outer edge hole is more than that of inner side.

(Continued)

*Primary Examiner*—Dinh Q. Nguyen
(74) *Attorney, Agent, or Firm*—Rothwell Figg Ernst & Manbeck

(57) ABSTRACT

An injector nozzle for a fuel injected internal combustion engine, said injector nozzle including a port (5) having a valve seat surface (15) and a valve member (3) having a seating surface (17), said valve member (3) being movable relative to the port (5) to respectively provide a nozzle passage (6) between the valve seat surface (15) and the seating surface (15) for the delivery of fuel therethrough or sealed contact therebetween to prevent said delivery of fuel, the valve member (3) including an outer valve surface (18) located adjacent the seating surface and external to the port, wherein a sharp edge (25) is provided on the valve member (3) at the transition between the seating surface (17) and the outer valve surface (18) thereby for controlling the formation of deposits at or adjacent an exit of the nozzle passage (6).

19 Claims, 3 Drawing Sheets

U.S. PATENT DOCUMENTS

| | | | | | |
|---|---|---|---|---|---|
| 4,905,908 | A | | 3/1990 | Sczomak | |
| 4,982,708 | A | * | 1/1991 | Stutzenberger | 123/297 |
| 5,522,550 | A | * | 6/1996 | Potz et al. | 239/533.9 |
| 5,551,638 | A | * | 9/1996 | Caley | 239/453 |
| 5,685,492 | A | * | 11/1997 | Davis et al. | 239/584 |
| 5,826,801 | A | * | 10/1998 | Kobayashi et al. | 239/533.4 |
| 5,839,411 | A | | 11/1998 | Schoell | |
| 5,988,532 | A | | 11/1999 | Alt et al. | |

OTHER PUBLICATIONS

Derwent Abstract Accession No. 97–007881/01, JP 08277765–A (ZEXEL KK) Oct. 22, 1996 Abstract and Figure Nozzle valve assembly—sets tilt angle of injection hole to axial line of valve more than tilt angel of valve seat to coaxial line of valve during max. lift of valve.

Derwent Abstract Accession No. 97–405662/38, JP 09177638–A (ZEXEL KK) Jul. 11, 1997 Abstract and Figure; Nozzle valve assembly for IC engine esp. Diesel engines—has annual groove whose lower and edge is positioned downards to injection hole.

* cited by examiner

DEPOSIT CONTROL IN FUEL INJECTOR NOZZLES

The present invention is generally directed to fuel injector nozzles of the outwardly opening poppet valve type, and in particular to the control of carbon deposits which may form on such injector nozzles.

Such injector nozzles typically deliver fuel in the form of a cylindrical or divergent conical spray. The nature of the shape of the fuel spray is generally dependent on a number of factors including, amongst other things, the geometry of the port and valve member constituting the nozzle, especially the surfaces of the port and valve member immediately adjacent the valve seat, where the port and valve engage to seal when the nozzle is closed to prevent the delivery of fuel therethrough. Once a nozzle geometry has been selected to give a required performance from the injector nozzle and hence the engine combustion system, relatively minor departures from that geometry can significantly impair the fuel delivery and combustion performance, particularly at low fuelling rates.

The attachment or build-up of solid combustion products or other deposits on the nozzle surfaces over which the fuel flows can be detrimental to the shape of the issuing fuel spray, the creation of the correct fuel distribution and hence the subsequent combustion process within the engine. The same can be said of deposit formation on the port and valve member terminal surfaces immediately adjacent the nozzle exit through which fuel is delivered. The principal cause of build-up on these surfaces is the adhesion thereto of carbon related or other particles that are produced by the combustion of fuel within the combustion chamber of the engine, including incomplete combustion of residual fuel which may remain on these surfaces between injection or combustion cycles.

It is known that a hollow fuel plume issuing from a nozzle initially follows a path principally determined by the exit direction and exit velocity of the fuel. It is also known that as the fuel plume advances beyond the delivery end of the injector nozzle that the reduction in the velocity of the fuel plume and the generally low pressure existing within the area bound by the plume immediately downstream of the nozzle promotes some inward contraction of the plume, often referred to as necking. In certain engine applications, this necking of the fuel plume provides certain advantages, particularly in regard to the desired containment of the fuel spray within the combustion chamber.

It has been found that disturbances to the fuel flow from the nozzle can significantly influence the shape and distribution of the fuel plume within the combustion chamber, particularly during and subsequent to the necking thereof. Such influences can promote unpredictable deflection and/or dispersion of the fuel, which in turn can adversely affect the combustion process and thus give rise to an increase in fuel consumption, undesirable levels of exhaust emissions, and also instability in engine operation, particularly at low load operation. Disturbances that can give rise to such undesirable influences or detrimental effects include the presence of irregular deposits on the surfaces defining the injector nozzle exit, such as carbonaceous and other combustion related deposits, eccentricity of the valve member and valve seat components of the nozzle, and/or excessive clearance between the stem of the valve member and the bore in which it axially moves as it opens and closes. Lateral movement or eccentricity of the valve member and deposits on the valve member or valve seat can each result in changes in the relative rate of flow over different sections of the periphery of the nozzle thus causing an asymmetric fuel plume.

The above discussed disturbances to the delivery of fuel to the combustion chamber of an engine are particularly significant in engines which, for at least part of engine load range, operate with a highly stratified fuel charge such as is recognised as highly desirable to control exhaust emissions, particularly during low load operation. An example of such a stratified charge engine is one employing a dual fluid fuel injection system such as that disclosed in the Applicants U.S. Pat. Nos. 4,693,224 and RE 36768, the contents of which are included herein by way of reference. In such a fuel injection system, individual metered quantities of fuel are delivered to the or each engine combustion chamber entrained in a quantity of gas, typically compressed air.

One way of improving the control of the shape and distribution of the fuel plume within the combustion chamber, and thereby the performance and efficiency of the injector nozzle, is by providing a projection extending beyond an extremity of the injector nozzle. Such an arrangement is for example described in the Applicants' U.S. Pat. Nos. 5,551,638 and 5,833,142, the details of which are incorporated herein by reference. The projection is configured and positioned such that the fuel plume issuing from the nozzle exit when the injector nozzle is open will embrace a portion of the projection adjacent the valve member and subsequently follow a path determined by the external surface of the projection.

Conveniently, the projection has a circular cross-section and preferably converges from a point along the projection towards the end thereof remote from the valve member. Conveniently, a necked portion provided between the valve member and the adjacent end of the projection provides a reduced cross-sectional area to thereby reduce the, area through which heat in the projection can flow to the valve member and hence be dissipated through the injector nozzle and to the engine cylinder or cylinder head. This feature, together with other aspects of the projection, contributes to the retainment of heat in the projection to thereby maintain the projection at a sufficiently high temperature to burn off or prevent the formation of any carbon or other deposits on the surface thereof.

Nonetheless, it has been found that in certain engine applications there may still occur some build-up of carbon deposits immediately adjacent the nozzle exit and on certain surfaces of the projection itself. This formation of carbon deposits at the injector nozzle exit surfaces has the ability to disrupt the injected spray plume thus altering the fuel spray characteristics within the combustion chamber. This may, as alluded to above, have a detrimental impact on combustion stability, smoke levels, fuel consumption and engine out emission levels, all which may ultimately lead to poor vehicle driveability and/or the inability to meet prescribed emissions or fuel economy targets.

It is therefore an object of the present invention to provide an improved injector nozzle that will minimise carbon build-up and the formation of deposits on the injector nozzle.

With this in mind, there is provided an injector nozzle for a fuel injected internal combustion engine, said injector nozzle including a port having a valve seat surface and a valve member having a seating surface, said valve member being movable relative to the port to respectively provide a nozzle passage between the valve seat surface and the seating surface for the delivery of fuel therethrough or sealed contact therebetween to prevent said delivery of fuel, the valve member including an outer valve surface located adjacent the seating surface and external to the port, wherein a sharp edge is provided on the valve member at the transition between the seating surface and the outer valve surface thereof, for controlling the formation of deposits at or adjacent an exit of the nozzle passage.

Preferably, the sharp edge acts as a deposit breaking edge to thereby facilitate deposit removal from the injector nozzle.

The port may include an outer port surface surrounding and located adjacent to the valve seat surface, and a sharp edge may preferably also be provided at the transition between the valve seat surface and the outer port surface. Hence, the sharp edged transition on the valve member is provided on the trailing edge of the valve member adjacent the exit point of the nozzle passage. Similarly, the sharp edged transition on the port is also preferably provided on the trailing edge of the port adjacent the exit point of the nozzle passage.

Preferably, the sharp edge on the valve member may be manufactured or provided thereon in a separate step to the provision of the sharp edge on the port. That is, the sharp edges on the port and valve member are preferably not machined in the same machining process and rather the sharp edge on the valve member is machined in a separate machining process to the sharp edge on the port. However, in certain circumstances it may be possible or desirable to machine both of the sharp edges in the same machining process. The machining process may include lapping or grinding of the surfaces.

According to one preferred embodiment, the angle between the seating surface and the outer valve surface of the valve member at the sharp edge transition may be at least substantially 90 degrees. Furthermore, the angle between the valve seat surface and the outer port surface of the port at the sharp edge transition may also be at least substantially 90 degrees.

Conveniently, an acute angle may be provided between the seating surface and the outer valve surface of the valve member at the sharp edge transition. Similarly, an acute angle may also be conveniently provided between the valve seat surface and the outer port surface of the port at the sharp edge transition.

The outer valve surface and the outer port surface may be at least substantially located in an common plane when the valve member is seated in the port. Alternatively, the outer valve surface and the outer port surface may be located in at least substantially parallel planes when the valve member is seated in the port. Further, when an acute angle is provided at the sharp edge transition of the valve member and at the sharp edge transition of the port, the angle between the outer valve surface and the outer port surface may conveniently be less than 180 degrees. Conveniently, the angle between these surfaces may be of the order of 90 degrees.

Conveniently, the injector nozzle is of the outwardly opening poppet valve type. However, the present invention may also have applicability to certain designs of inwardly opening pintle valve arrangements.

Preferably, the injector nozzle is arranged to deliver fuel directly into a combustion chamber of the engine. However, whilst the present invention may have particular applicability to direct fuel injection systems, it is also applicable to other types of fuel systems such as manifold or port injection type systems.

The internal valve seat surface of the port and the external seating surface of the valve member may together dictate the exit trajectory or direction of a fuel spray as it is delivered from the injector nozzle. Generally, this exit trajectory will follow an imaginary extension of the passage between the valve seat surface and the external seating surface and more particularly the direction of the passage nearest the outermost extremity of the injector nozzle. Conveniently, the exit trajectory of the fuel spray is acutely angled with respect to the longitudinal axis of the injector nozzle. That is, the exit trajectory of the fuel spray will in general vary axially from the direction of movement of the valve member by an angle of less than 90 degrees. Conveniently, the exit trajectory will be axially angled with respect to the direction of movement of the valve member by about 45 degrees.

Conveniently, the outer port surface and the outer valve surface are arranged to be at least substantially normal to the fuel exit trajectory. Alternatively, the angles between each of the outer valve surface and the outer port surface and the fuel exit trajectory beyond an extremity of the nozzle are arranged to be greater than 90 degrees.

The valve member may include a projection extending beyond the extremity of the nozzle for controlling the shape of the fuel spray or plume issuing from the nozzle. The projection may be any one of the types discussed in the Applicant's U.S. Pat. Nos. 5,551,638 and 5,833,142. Further, the projection may be one according to any of the designs discussed in the Applicant's Co-pending PCT Patent Application No. PCT/AU01/00382 filed on Apr. 5, 2001. Alternatively, the projection may be of any other configuration suitable to control the shape of the fuel plume.

The present invention may be used on injector valves where the valve member is heel seated within the port. It is however also possible for the present invention to be used on injector valves where the valve member is toe seated within the port. In this connection, the distinction between heel and toe seated relates to the location of the seat-line between the valve member and the port. For example, toe seated equates to the scenario where the seat-line is closer to the outermost extremity of the nozzle.

Preferably, the sharp edges on the valve member and port are located immediately adjacent each other when the valve member is seated in the port to prevent fuel flow through the nozzle passage. In such an arrangement, the seat-line between the valve member and the port may be located upstream of the exit of the nozzle passage and within said passage such that a narrow gap exists downstream of the seat-line, said narrow gap terminating at the sharp edges. Alternatively, the seat-line may be provided at or immediately adjacent the sharp edges such that the sharp edges are arranged to contact when the valve member is seated within the port.

Conveniently, the gap between the seating surface and the valve seat surface where the valve member is seated within the port may be minimised to be less than a predetermined width so as to further restrict the formation of any deposits within the nozzle passage. In this connection the width of the gap may correspond to that as described in either of the Applicant's U.S. Pat. Nos. 5,593,095 and 5,685,492, the contents of which are included herein by way of reference.

The injector nozzle of the present invention has application to both single fluid and dual fluid fuel injection systems for a variety of engine applications. The injector nozzle does however have particular applicability to dual fluid fuel systems where metered quantities of fuel are delivered to the engine entrained in compressed air. In such fuel systems, the fuel issuing from the injector nozzle typically does so in the form of a spray or cloud of fuel droplets and vapour. The trajectory of the fuel spray, which is delivered by way of comparatively low pressure compressed air, is influenced by the nozzle exit surfaces and/or any projection or flow control means located downstream of the injector nozzle to influence the shape and distribution of the fuel plume within the combustion chamber. Such dual fluid systems are disclosed for example in the Applicant's U.S. Pat. Nos. 4,693,224, 4,934,329 and RE 36768, the contents of which are incorporated herein by way of reference.

The provision of sharp edges on the valve member and preferably also on the port facilitates the maintenance of an optimal nozzle exit spray geometry preventing over expansion of the fuel plume at the exit of the nozzle passage and thereby reducing droplet impingement on the outer surfaces of the nozzle leading to improved deposit control. That is, the provision of the sharp edged transition on the valve member and preferably also the port minimises the likelihood of a bias being created in the spray direction such that it is towards the external surfaces of the valve member and/or valve port. Impingement of gasoline droplets on the valve member and/or port external surfaces may serve to reduce the temperature of the trailing edges of the valve member or valve port which may support the formation of deposits at or adjacent these regions.

Furthermore, the sharp edges act as deposit breaking edges adjacent to the exit of the nozzle passage thus controlling deposit build-up at the nozzle exit by the physical mechanism of deposit shear. That is, any deposits which may form at or adjacent either of the sharp edged transition regions are likely to exhibit increased localised stress characteristics and thus have a fairly weak resistance to fracturing. Accordingly, any deposits which may form at or adjacent these sharp edges are likely to be dislodged by the shearing effect of the fuel issuing from the exit of the nozzle passage. Such a flow of fuel alongside and across any such deposits will typically result in the deposits closest to the nozzle passage exit being broken away. Further, other localised eddies and gas currents present in the combustion chamber, and particularly at or adjacent the nozzle passage exit, may also cause some such deposits to be dislodged from the sharp edged transition regions. Still further, the presence of the sharp edged transition regions on the valve member and the part, together with the mechanical opening and closing movement of the valve member within the part, may also contribute to some physical dislodgement of any deposits which may form at or adjacent the exit of the nozzle passage.

It will be convenient to further describe the invention with respect to the accompanying drawings which illustrate a preferred embodiment of the present invention. Other arrangements of the invention are however also possible, and consequently, the particularity of the accompanying drawings is not to be understood as superseding the generality of the preceding description of the invention.

Figure 1:
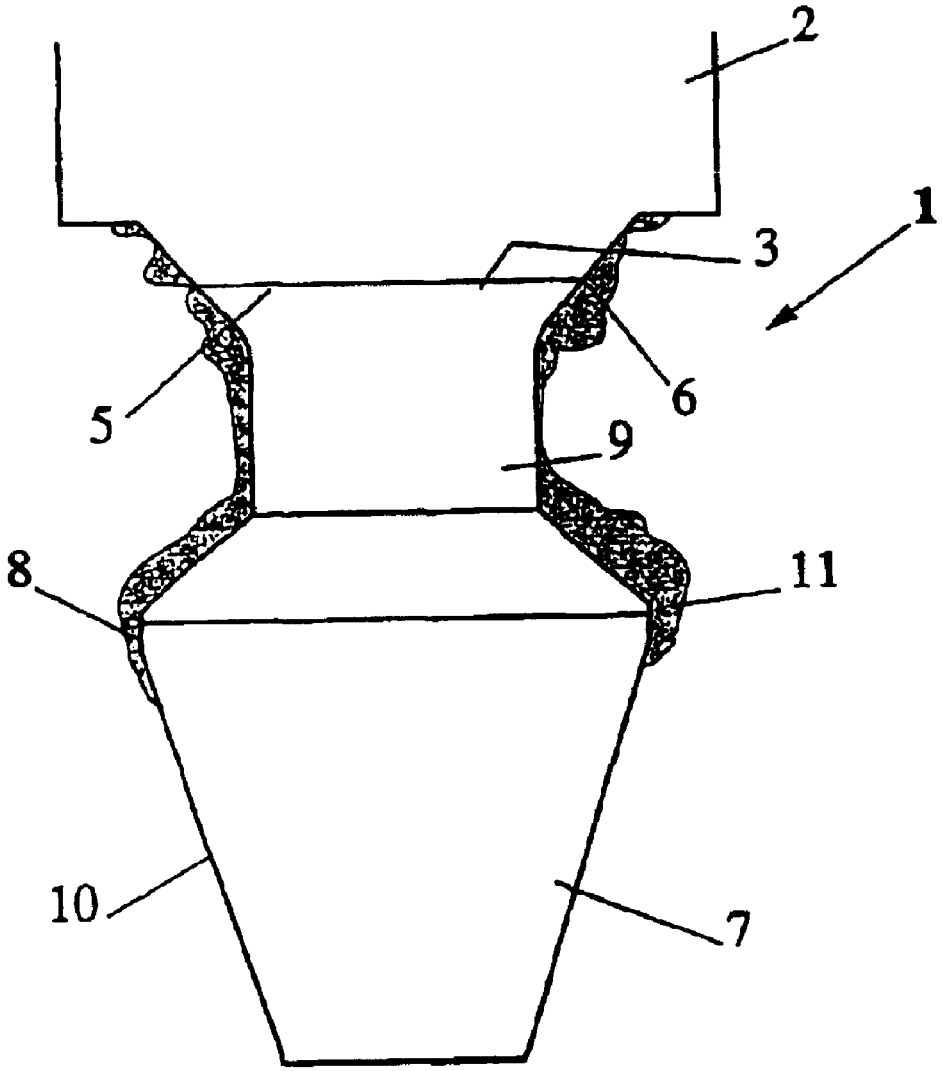
FIG. 1 is a schematic side view of the nozzle portion of a prior art fuel injector nozzle.

FIG. 1 is a schematic view showing the nozzle geometry of a known poppet valve type fuel injector nozzle 1. This injector nozzle 1 includes a nozzle body 2 supporting a valve member 3 with a port 5 being provided at a lower extremity of the nozzle body 2. A nozzle passage 6 is provided between the port 5 and the valve member 3 when the valve member 3 is in an open position and sealing engagement exists between the port 5 and the valve member 3 when the valve member 3 is in a closed position.

The valve member 3 includes a fuel plume guide projection 7 dependent from and connected thereto by a necked-in portion 9. The projection 7 has a maximum diameter 8 which is selected so that the fuel plume issuing from the exit point of the nozzle passage 6 when the valve member 3 is in an open position will follow a path based on the external surface 10 of the projection 7. The injector nozzle 1 is typically arranged to deliver fuel directly into the combustion chamber of an engine and so the lower portion thereof is exposed to the pressures, temperatures and combustion gases which exist within the engine combustion chamber during engine operation.

FIG. 1 also schematically shows the type of carbon deposit formation 11 that may occur on the injector nozzle 1 after prolonged use of the injector nozzle 1. This carbon formation 11 can accumulate adjacent the exit of the nozzle passage 6 and on the projection 7 and necked-in portion 9. This carbon formation 11 can potentially seriously affect the efficiency and performance of the injector nozzle as described previously. More particularly, the deposits which may build-up adjacent the nozzle exit surfaces defined by the port 5 and valve member 3 can impede the fuel spray issuing from the nozzle passage 6 and hence effect the shape and distribution of the resulting spray plume into the combustion chamber.

Figure 2:
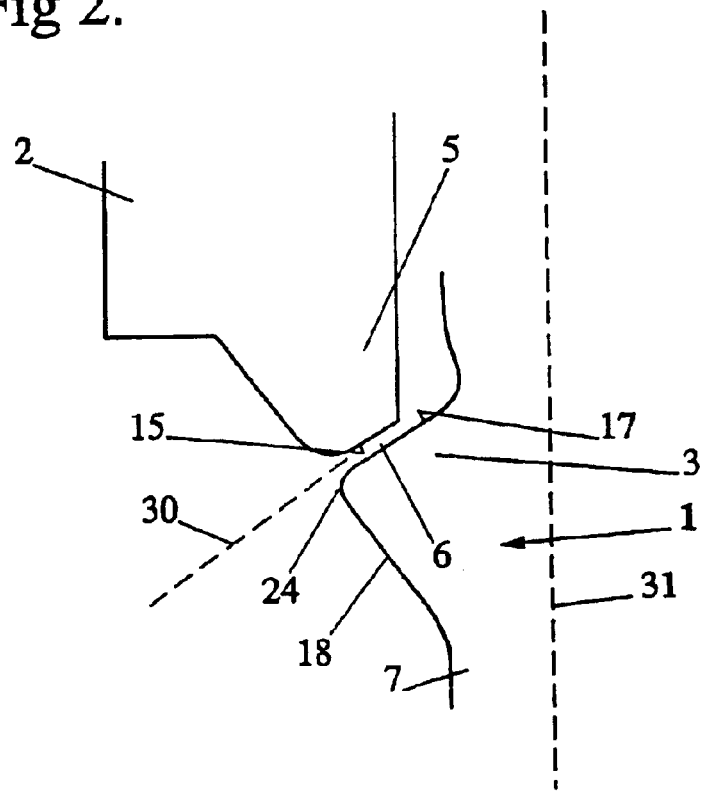
FIG. 2 is a detailed view of the nozzle geometry at the nozzle passage exit of a prior art injector nozzle.

Referring now to FIG. 2, the nozzle geometry at the nozzle passage 6 of a prior art injector nozzle 1 is shown. The nozzle 1 is in an open position with the nozzle passage 6 being provided between the port 5 and the valve member 3. The nozzle body 2 supports a valve seat surface 15 of the port 5. The valve member 3 includes a seating surface 17 which cooperates with the valve seat surface 15 to define the nozzle passage 6. When the valve seating surface 17 is seated on the valve seat surface 15, no fuel is able to flow through the passage 6 due to the sealing engagement which exists between the port 5 and the valve member 3. Movement of the valve member 3 relative to the port 5 occurs along a longitudinal axis which corresponds to the axis of the injector nozzle 1 which is shown as line 31.

The valve member 3 further includes an outer valve surface 18 located adjacent to the seating surface 17 of the valve member 3. At the transition area 24 between the seating surface 17 and the outer valve surface 18 of the valve member 3, a slight radius is typically provided therebetween. This is generally a function of the manufacturing process typically used to produce the valve member 3, This radius is typically in the order of about 0.2 mm. As alluded to hereinbefore, the discontinuity provided by this radius at the exit of the nozzle passage 6 may result in an over expansion of the fuel spray issuing from the nozzle 1 which may serve to promote the formation of deposits on the outer valve surface 18. Such deposits are typically detrimental to the emissions capability of an engine.

Figure 3:
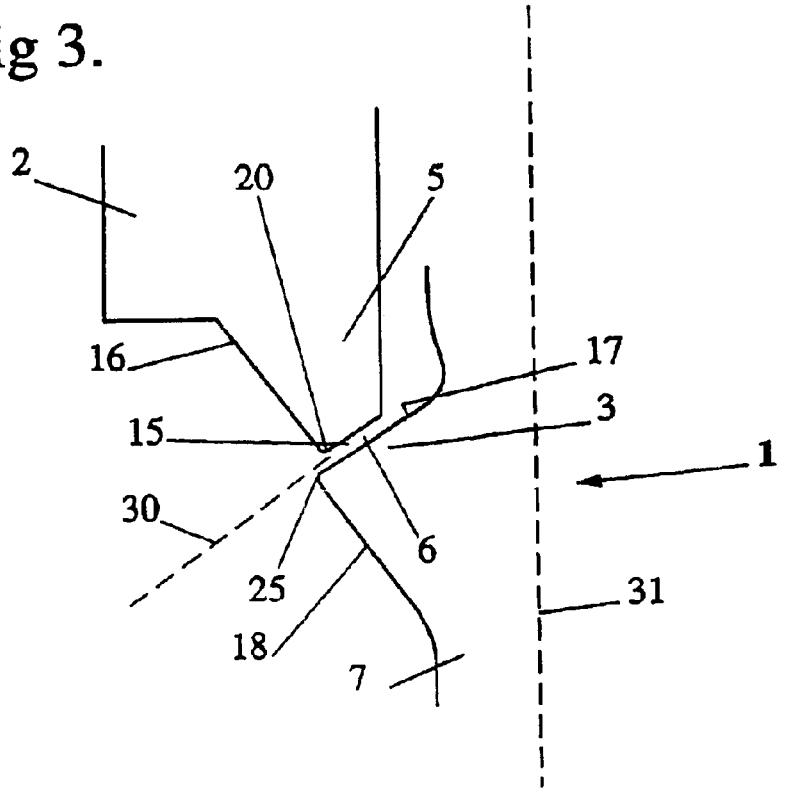
FIG. 3 is a detailed view showing the nozzle geometry at the nozzle passage exit of an injector nozzle according to one preferred embodiment of the present invention.

FIG. 3 shows the nozzle geometry of an injector nozzle 1 according to the present invention. It should be noted that the same reference numerals are used on the corresponding components of the injector nozzle 1 for clarity purposes.

The Applicant has found that by providing a sharp edge 25 at the transition between the seating surface 17 and the outer valve surface 18, that this can assist in reducing the formation of carbon deposits on the injector nozzle 1. This sharp edge may for example be produced by a machining process such as lapping or grinding of the seating surface 17 and outer valve surface 18 to thereby produce the sharp edge 25 at the transition between these surfaces.

A sharp edge 20 may also be provided between the valve seat surface 15 and an outer port surface 16 surrounding and located adjacent the valve seat surface 15. The same machining process can be used to produce the sharp edge 20 as described above. Each of the sharp edges 25, 20 are formed on trailing edges of the valve member 3 and the port 5 and each of the sharp edges 25, 20 is adjacent the exit point of the nozzle passage 6.

Figure 4:
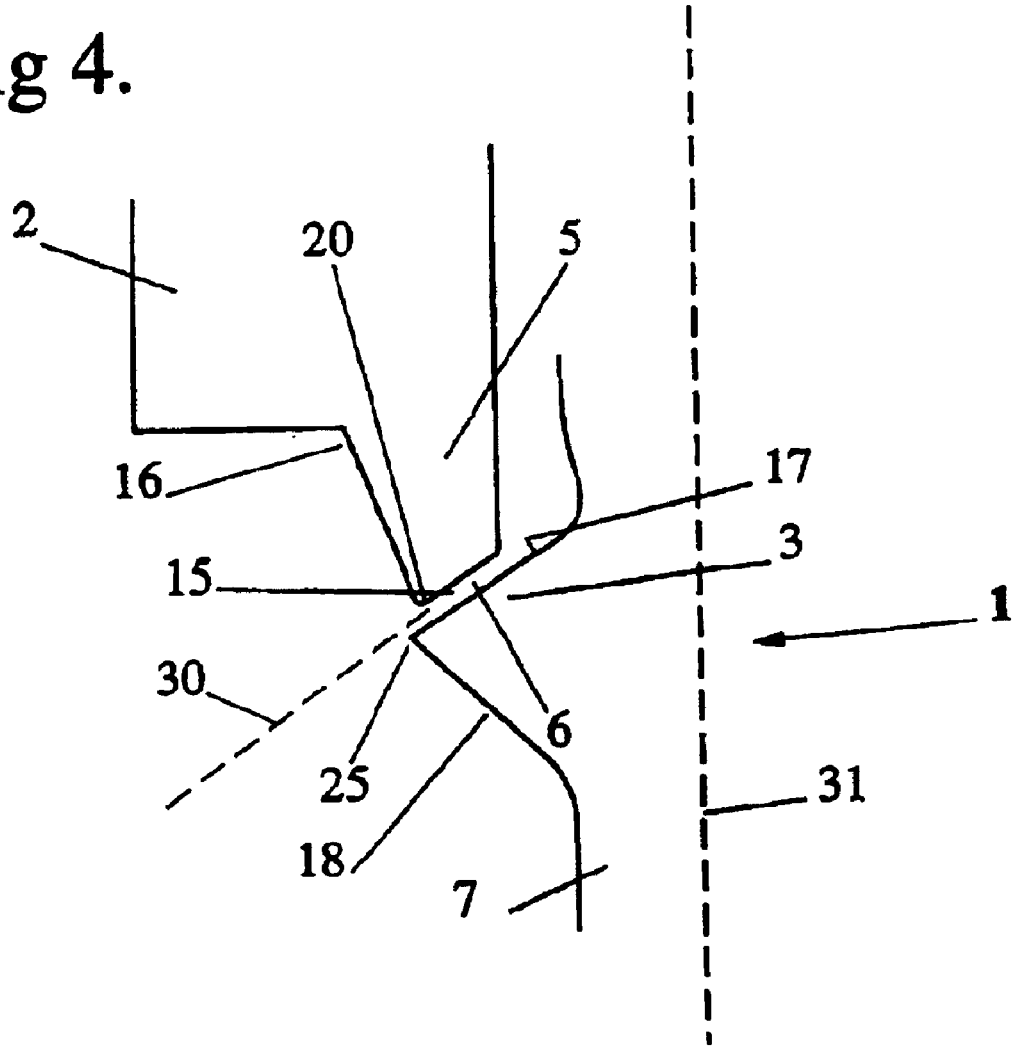
FIG. 4 is a detailed view showing the nozzle geometry at the nozzle passage exit of an injector nozzle according to another preferred embodiment of the present invention.

In the arrangement shown in FIG. 3, the outer valve surface 18 and the outer port surface 16 are provided in planes normal to the fuel exit trajectory from the nozzle 1 as indicated by the dashed line 30. Furthermore, the surfaces 18, 16 are arranged in the same plane when the valve member 3 is seated within the port 5. As alluded to hereinbefore, one or each of the surfaces 18, 16 may of course be arranged to be angled to the fuel exit trajectory 30 by greater than 90 degrees which would result in an acute angle at the transition edges 25, 20. For example, as shown in FIG. 4 acute angles may be provided at the transition edges 25, 20 such that the angle between the outer valve surface 18 and the outer port surface is less than 180 degrees and perhaps of the order of 90 degrees. Still further, the surfaces 18, 16 may alternatively be arranged such that, whilst being normal to the fuel exit trajectory 30, they exist in parallel planes when the valve member 3 is seated within the port 5.

Whilst it may in some circumstances be possible or desirable to machine both sharp edges 25, 20 in the same machining process, it is more typical that the sharp edge 25 on the valve member 3 is machined in a separate process to the port 5.

It has been found that the provision of the sharp edge 25 on the valve member 3, and preferably also the sharp edge 20 on the port 5 facilitates the maintenance of an optimal nozzle exit spray geometry preventing over-expansion of the fuel plume at the exit of the nozzle passage 6 and thereby reducing droplet impingement on the outer surfaces of the nozzle leading to improved deposit control. Furthermore, the sharp edges 25, 20 act as deposit breaking edges adjacent to the exit of the nozzle passage 6 thereby controlling nozzle exit deposit build-up by the physical mechanism of deposit shear. Hence, any deposits that may form at or adjacent the nozzle passage exit and on the trailing edges of the valve member 3 or port 5 will be dislodged or broken away by the shearing action of the fuel issuing from the nozzle passage 6 or the gas dynamics within the combustion chamber of the engine. Accordingly, the formation of any deposits which may impede or otherwise detrimentally effect the flow of fuel from the nozzle 1 can be minimised. Deposits which may form at or adjacent the exit of the nozzle passage 6 may also be dislodged by the mechanical opening and closing action of the valve member 3 within the port 5, particularly in the case of a toe-seated nozzle arrangement.

The injector nozzle of the present invention has application to both single and dual fluid injection systems and may be adapted for use together with any other deposit control concepts. For example, the features of the injector nozzle may be combined with aspects relating to flow control, temperature control, surface finish and material selection. The injector nozzle of the present invention has applicability to direct injected engines and particularly those operating with a stratified fuel distribution at some point of the engine operating locad range. Furthermore, although the present invention has been described with respect to injector nozzles incorporating a flow control projection, it is to be appreciated that the present invention is equally applicable for injector nozzles that do not incorporate such projections.

By minimising the formation of deposits at and adjacent to the exit of the nozzle passage 6, the present invention is able to facilitate a more reliable and repeatable fuel spray delivery from the port 5.

Variations as would be deemed obvious to the person skilled in the art are included within the ambit of the present invention as defined in the appended claims.

What is claimed is:

1. An injector nozzle for a fuel injected internal combustion engine, said injector nozzle including a port having a valve seat surface and valve member having a seating surface, said valve member being movable relative to the port to respectively provide a nozzle passage between the valve seat surface and the seating surface for the delivery of fuel there-through or sealed contact there-between to prevent said delivery of fuel, the valve member including an outer valve surface located adjacent the seating surface and external to the port, wherein a sharp edge is provided on the valve member at the transition between the seating surface and the outer valve surface thereof, for controlling the formation of deposits at or adjacent an exit of the nozzle passage.

2. An injector nozzle according to claim 1, wherein the sharp edge acts as a deposit breaking edge to thereby facilitate deposit removal from the injector nozzle.

3. An injector nozzle according to claim 1, wherein the angle between the seating surface and the outer valve surface and the outer valve surface of the valve member at the sharp edge transition.

4. An injector nozzle according to claim 1, wherein an acute angle is provided between the seating surface and the outer valve surface of the valve member at the sharp edge transition.

5. An injector nozzle according to claim 1, wherein the port includes an outer port surface surrounding and located adjacent to the valve seat surface, and a sharp edge is provided at the transition between the valve seat surface and the outer port surface.

6. An injector nozzle according to claim 5, wherein the angle between the valve seat surface and the outer port surface of the port at the sharp edge transition is at least substantially 90 degrees.

7. An injector nozzle according to claim 5, wherein an acute angle is provided between the valve seat surface and the outer port surface of the port at the sharp edge transition.

8. An injector nozzle according to claim 5, wherein the outer valve surface and the outer port surface are at least substantially located in an common plane when the valve member is seated in the port.

9. An injector nozzle according to claim 5, wherein the outer valve surface and the outer port surface are located in at least substantially parallel planes when the valve member is seated in the port.

10. An injector nozzle according to claim 5, wherein the angle between the outer valve surface and the outer port surface is less than 180 degrees.

11. An injector nozzle according to claim 5, wherein the angle between the outer valve surface and the outer port surface is of the order of 90 degrees.

12. An injector nozzle according to claim 5, wherein the angles between each of the outer valve surface and the outer port surface and a fuel exit trajectory of the fuel exiting the nozzle passage.

13. An injector nozzle according to claim 5, wherein the angles between each of the outer valve surface and the outer port surface and a fuel exit trajectory are arranged to be greater than 90 degrees.

14. An injector nozzle according to claim 1, the nozzle being of the outwardly opening poppet valve type.

15. An injector nozzle according to claim 1, the nozzle being arranged to deliver fuel directly into at least one combustion chamber of the engine.

16. An injector nozzle according to claim 5, wherein the sharp edge on the valve member is formed in a separate step to the sharp edge on the port.

17. An injector nozzle according to claim 1, wherein a projection is arranged beyond the extremity of the nozzle for controlling the shape of the fuel spray issuing from the nozzle.

18. An injector nozzle according to claim 5, wherein the sharp edges on the valve member and on the port facilitates the maintenance of an optimal nozzle exit spray geometry thereby preventing over expansion of the fuel spray at the exit of the nozzle passage.

19. An injector nozzle for a spark-ignited fuel injected internal combustion engine operated in stratified charge mode, said injector nozzle including a port having a valve seat surface and valve member having a seating surface, said valve member being movable relative to the port to respectively provide a nozzle passage between the valve seat surface and the seating surface for the delivery of fuel therethrough or sealed contact therebetween to prevent said delivery of fuel, the valve member including an outer valve surface located adjacent the seating surface and external to the port, wherein a sharp edge is provided on the valve member at the transition between the seating surface and the outer valve surface thereof, for controlling the formation of deposits at or adjacent an exit of the nozzle passage.

* * * * *